US010281196B2

(12) United States Patent
Seeley

(10) Patent No.: US 10,281,196 B2
(45) Date of Patent: May 7, 2019

(54) INTEGRATED ACCESSORY INTERFACE FOR REFRIGERATORS AND CRISPER DRAWERS

(71) Applicant: WHIRLPOOL CORPORATION, Benton Harbor, MI (US)

(72) Inventor: Michael S. Seeley, South Haven, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 0 days.

(21) Appl. No.: 15/385,967

(22) Filed: Dec. 21, 2016

(65) Prior Publication Data

US 2018/0172338 A1 Jun. 21, 2018

(51) Int. Cl.

| | |
|---|---|
| ***F25D 23/06*** | (2006.01) |
| ***F25D 11/02*** | (2006.01) |
| ***F25D 25/02*** | (2006.01) |

(52) U.S. Cl.

CPC ..... *F25D 23/067* (2013.01); *F25D 11/02* (2013.01); *F25D 25/025* (2013.01)

(58) Field of Classification Search

CPC ..... F25D 11/02; F25D 23/067; F25D 25/025

USPC ..... 312/401, 404, 405, 408, 348.3, 406; 62/382; 211/90.01, 119.003

See application file for complete search history.

(56) References Cited

U.S. PATENT DOCUMENTS

| | | | | |
|---|---|---|---|---|
| 3,178,061 | A * | 4/1965 | Giacalone | F25D 23/04 222/129 |
| 5,138,803 | A * | 8/1992 | Grossen | A47F 5/0846 211/103 |
| 5,711,115 | A * | 1/1998 | Wirt | F24B 1/198 52/36.3 |
| 7,300,120 | B2 | 11/2007 | Shin | |
| 8,517,483 | B2 | 8/2013 | Eubanks et al. | |
| 8,616,665 | B2 | 12/2013 | Czach et al. | |
| D722,622 | S | 2/2015 | Kim et al. | |
| 9,389,012 | B2 | 7/2016 | Rackley et al. | |
| 9,400,132 | B2 | 7/2016 | Schrader et al. | |
| 2004/0145287 | A1* | 7/2004 | Ernst | A47B 88/90 312/348.3 |
| 2012/0286637 | A1* | 11/2012 | Fehre | A47B 88/941 312/330.1 |
| 2015/0028026 | A1 | 1/2015 | Rajasekaran et al. | |
| 2016/0123655 | A1 | 5/2016 | Chow et al. | |

* cited by examiner

*Primary Examiner* — James O Hansen

(74) *Attorney, Agent, or Firm* — Price Heneveld LLP

(57) ABSTRACT

An appliance having an appliance cabinet has at least one food storage compartment and an accessory removably mounted within the food storage compartment. An integrated accessory interface having a horizontally extending channel defining an upwardly extending curvilinear cavity is disposed within the food storage compartment, and an upwardly extending curvilinear integral tab is disposed proximate an upper portion of the accessory. The curvilinear integral tab extending outwardly and upwardly from the accessory and adapted to engage the channel to removably mount and retain the accessory within the appliance cabinet, wherein the curvilinear integral tab of the accessory is rotationally received within the horizontally extending channel.

13 Claims, 7 Drawing Sheets

INTEGRATED ACCESSORY INTERFACE FOR REFRIGERATORS AND CRISPER DRAWERS

FIELD OF THE INVENTION

The present disclosure generally relates to an appliance having an improved integrated accessory interface and the method for mounting an accessory therewith.

BACKGROUND

Domestic refrigerators typically include shelves, crisper drawers, refrigerator door bins, and other structures within a food storage compartment in which food items may be placed and stored. In certain circumstances, it may also be desirable to mount an accessory within the food storage compartment and, in particular, within the crisper drawer. However, given that the volume within a food storage compartment, including the crisper drawers, is often limited, it is desirable that the accessory be somehow discreetly mounted within the crisper drawer so as to consume as little volume as possible and to be safely retained in position, while at the same time providing ready attachment and removal. An accessory interface that would provide an improvement to existing accessory interfaces is desired.

BRIEF SUMMARY OF THE INVENTION

According to one aspect of the disclosure, the present disclosure provides an appliance having an appliance cabinet having at least one food storage compartment and an accessory removably mounted within the food storage compartment. An integrated accessory interface having a horizontally extending channel defining an upwardly extending curvilinear cavity is disposed within the food storage compartment, and an upwardly extending curvilinear integral tab is disposed proximate an upper portion of the accessory. The curvilinear integral tab extends outwardly and upwardly from the accessory and is adapted to engage the channel to removably mount and retain the accessory within the appliance cabinet, wherein the curvilinear integral tab of the accessory is rotationally received within the horizontally extending channel.

Another aspect of the present disclosure is generally directed toward an integrated accessory interface for mounting an accessory within an appliance cabinet. The appliance cabinet has at least one food storage compartment defined by a vertically extending rear wall, a pair of vertically extending opposed side walls, a movable closure panel, and a crisper drawer slidably mounted within the food storage compartment. The crisper drawer further includes a wall defined by a horizontally extending extruded body having a vertical cross-sectional profile, an inner surface, and an outer surface. The integrated accessory interface comprises a horizontally extending channel defining an upwardly extending curvilinear cavity integrally formed on the wall of the crisper drawer, a corresponding curvilinear tab integrally formed with and disposed proximate an upper portion of the accessory, the curvilinear integral tab extending outwardly and upwardly and adapted to rotationally engage the horizontally extending channel, a plurality of horizontally extending notches disposed on the wall of the crisper drawer below the horizontally extending channel in regular vertical intervals, and a plurality of horizontally extending ridges disposed on the accessory that are received within the notches and disposed below the curvilinear integral tab in regular vertical intervals, the plurality of horizontally extending ridges corresponding to the plurality of horizontally extending notches.

Yet a further aspect of the present disclosure is generally directed toward a method of mounting an accessory having a facing wall within an appliance cabinet, the appliance cabinet having at least one food storage compartment comprising a vertically extending rear wall, a pair of vertically extending opposed side walls, and a movable closure panel. The method includes the steps of disposing a horizontally extending channel within the food storage compartment, the horizontally extending channel comprising an upwardly extending curvilinear cavity, disposing an upwardly extending curvilinear integral tab proximate an upper portion of the facing wall of the accessory, the curvilinear integral tab extending outwardly and upwardly from the facing wall and adapted to engage the horizontally extending channel to removably mount and retain the accessory within the appliance cabinet, and rotationally inserting the curvilinear integral tab within the horizontally extending channel.

These and other features, advantages, and objects of the present disclosure will be further understood and appreciated by those skilled in the art by reference to the following specification, claims, and appended drawings.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings, certain embodiment(s) which are presently preferred. It should be understood, however, that the invention is not limited to the precise arrangements and instrumentalities shown. Drawings are not necessarily to scale. Certain features of the invention may be exaggerated in scale or shown in schematic form in the interest of clarity and conciseness.

In the drawings.

DETAILED DESCRIPTION OF THE PREFERRED EMBODIMENTS

Before the subject invention is described further, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

In this specification and the appended claims, the singular forms "a," "an," and "the" include plural reference unless the context clearly dictates otherwise.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

For purposes of this disclosure, the terms "operably coupled" and "operably connected" generally mean that one component functions with respect to another component, even if there are other components located between the first and second components, and the term "operable" defines a functional relationship between components.

Figure 1:
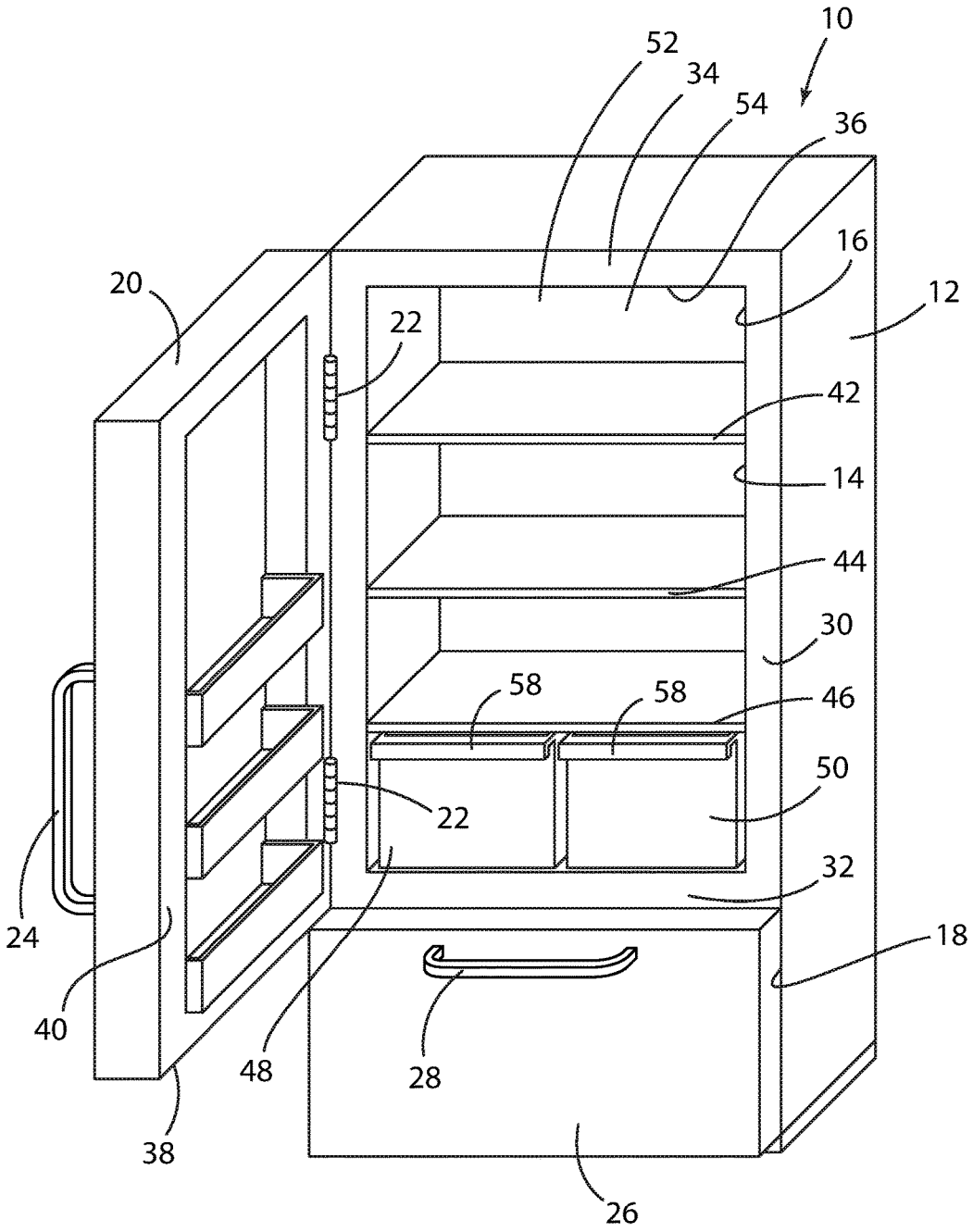
FIG. 1 is a front perspective view of an appliance cabinet having at least one food storage compartment adapted to employ the integrated accessory interface of the present disclosure.
Figure 2:
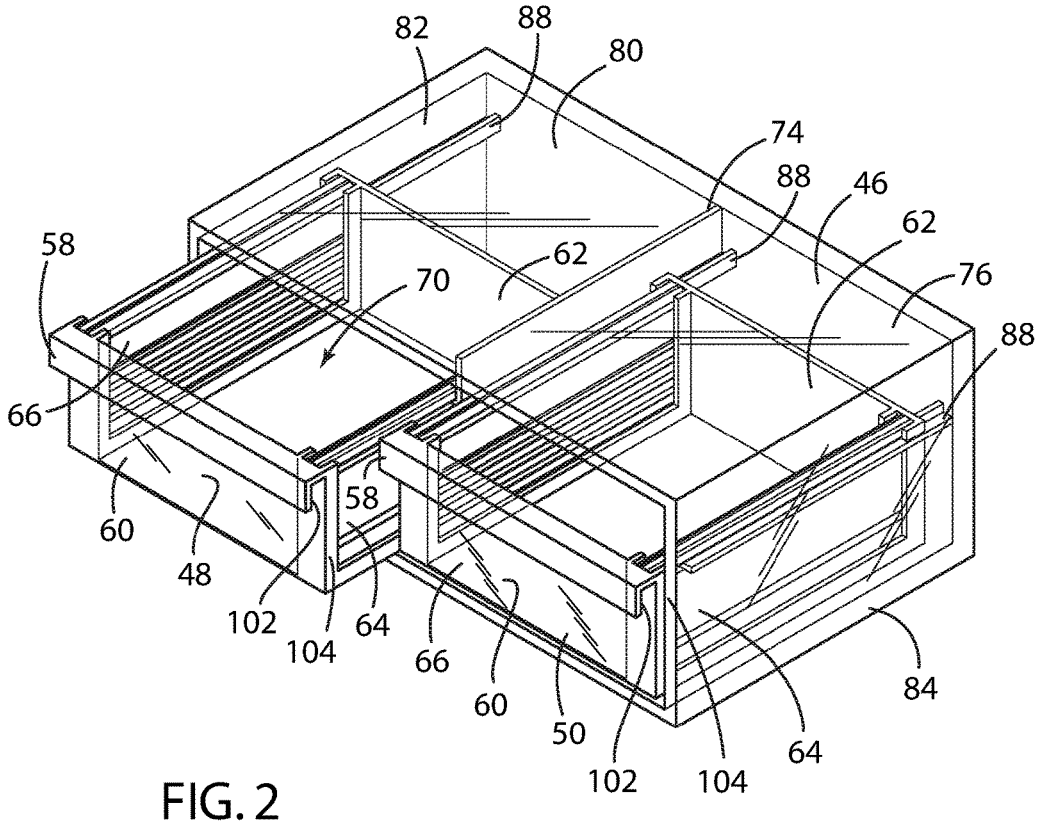
FIG. 2 is a front perspective view of a crisper drawer frame structure and crisper drawers adapted to employ the integrated accessory interface of the present disclosure.
Figure 3:
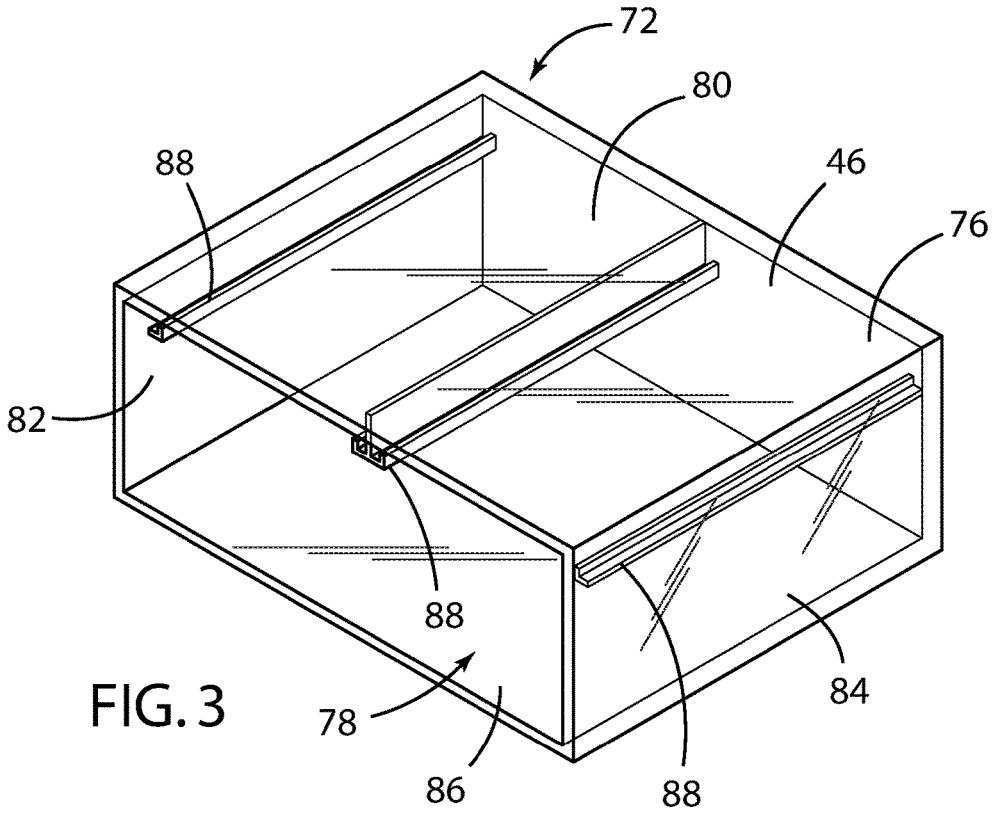
FIG. 3 is a front perspective view of the crisper drawer frame structure shown in FIG. 2.

As shown in FIG. 1, reference number 10 generally designates an appliance which in the disclosed embodiment comprises a domestic refrigerator 10. The refrigerator 10 includes a refrigerator housing 12, which defines one or more food storage compartments 14, such as a refrigerator compartment 16 and a freezer compartment 18, and a refrigeration system (not shown) for providing relatively cooler air within the food storage compartment. A refrigerator door 20 is hinged to the front of the refrigerator housing 12 via a pair of hinge assemblies 22. The refrigerator door 20 permits user access to the refrigerator compartment 16, such that food items may be placed in and retrieved from the refrigerator 10. A handle 24 is located on the refrigerator door 20 and the user may use the handle 24 to pull the refrigerator door 20 open. The freezer compartment 18 is shown positioned below the refrigerator compartment 16. It, too, is provided with an openable freezer door 26 and handle 28. Typically, the freezer door 26 may be pulled open to expose a slidable container (not shown). It will be appreciated that in other embodiments the freezer compartment 18 may be positioned above or side-by-side with the refrigerator compartment 16. It will be further appreciated that in other embodiments the refrigerator 10 may not have a freezer compartment 18. Additionally, it should be appreciated that more than one refrigerator door 20 and freezer door 26 may permit access to, for example, the refrigerator compartment 16 or the freezer compartment 18, respectively. The refrigerator 10 may also include more than one refrigerator compartment 16 and/or more than one freezer compartment 18.

The refrigerator compartment 16 includes a number of side walls 30 that extend upwardly from a bottom wall 32 to a top wall 34, thereby defining the refrigerator compartment 16. The open front side of the refrigerator compartment 16 defines an access opening 36, which provides user access to the refrigerator compartment 16 when the refrigerator door 20 is open. When the refrigerator door 20 is closed, an outer edge 38 of the back panel 40 of the refrigerator door 20 seals the access opening 36, thereby preventing the user from accessing the refrigerator compartment 16. The refrigerator door 20 also prevents chilled air from escaping through the access opening 36 of the refrigerator 10.

A user may place and store food items, such as milk, cheese, meats, produce, etc. in the refrigerator compartment 16 and/or the freezer compartment 18. The refrigerator compartment 16 is operable to maintain stored food items within a predefined range or ranges of temperatures. The freezer compartment 18 is operable to separately maintain stored food items typically within a lower predefined range or ranges of temperatures.

The refrigerator compartment 16 preferably includes a variety of shelves 42, 44, 46 and drawers 48, 50. As shown, the refrigerator compartment 16 includes an upper shelf 42, a middle shelf 44, and a lower shelf 46 positioned within the refrigerator compartment 16 mounted to an interior surface 52 of the food storage compartment 14 within a back wall 54 of the food storage compartment 14, or attached to a crisper drawer frame structure 56, as described below.

The refrigerator compartment 16 preferably includes the pair of crisper drawers 48, 50 positioned below the lower shelf 46. The crisper drawers 48, 50 are configured to extend from and retract into the refrigerator compartment 16. The crisper drawers 48, 50 each include handles 58 that permit the user to extend and retract the crisper drawers 48, 50. Each of the crisper drawers 48, 50 is preferably formed from injection molded clear polypropylene. It will be appreciated that in other embodiments the polypropylene may be opaque or colored. It will also be appreciated that the crisper drawers 48, 50 may be formed from other suitable plastics and may include metal assemblies, such as rollers or sliders, as noted below, that allow the crisper drawers 48, 50 to extend and retract.

The crisper drawers 48, 50 are preferably configured as a generally rectangular structure, which includes a front wall 60, a back wall 62, a pair of opposed side walls 64, 66, and a bottom wall 68. Each of the crisper drawers 48, 50 comprises a top side 70 that is preferably open, thereby defining a storage chamber 72 in which the user may place items to be stored. The open top side 70 of the crisper drawers 48, 50 provides user access to the storage chamber 72 when the crisper drawers 48, 50 are extended from the refrigerator compartment 16.

The food storage compartment 14 also preferably includes a rectangular crisper drawer frame structure 74 disposed below and which supports a glass panel 76 that forms the lower shelf 46 within which the crisper drawers 48, 50 are received. The crisper drawers 48, 50 are preferably slidably mounted within the food storage compartment 14 via the crisper drawer frame structure 74, which has an open front 78, a back wall 80, a pair of opposed side walls 82, 84, and a bottom wall 86. A set of support rails 88 is provided in the crisper drawer frame structure 74 for each crisper drawer 48, 50 that is in turn engaged by one of pair of rails 90 mounted on each of the pair of opposed side walls 64, 66 of the crisper drawers 48, 50. Each support rail 88 provides vertical support to the crisper drawers 48, 50, and the engagement between the rail 90 provided on each side of the crisper drawers 48, 50 and the support rails 88 permits the crisper drawers 48, 50 to be slidably mounted in a selected location. Additional features, such as rollers or sliders, can be added to each of the support rails 88 to further facilitate movement of the crisper drawers 48, 50 within the food storage compartment 14. Additionally, features may be added to facilitate ready removal of the crisper drawers 48, 50 from the food storage compartment 14, as are known in the art.

Figure 6:
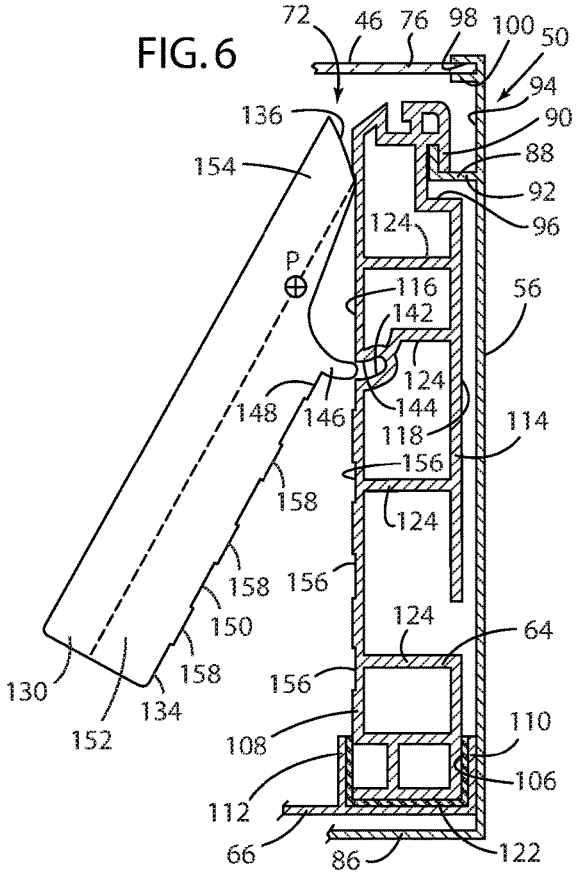
FIG. 6 is a side cross-sectional view of the integrated accessory interface of the present disclosure prior to assembly.
Figure 7:
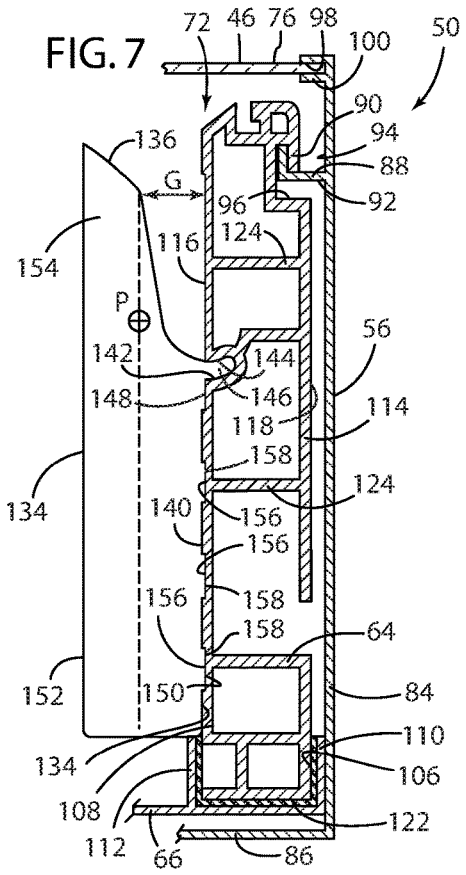
FIG. 7 is a side cross-sectional view of the integrated accessory interface of the present disclosure subsequent to assembly.

The support rails 88 positioned within the crisper drawer frame structure 74 preferably are formed from extruded aluminum. It should be appreciated that in other embodiments, the support rails 88 may be formed from another metallic material, such as, for example, a steel or a metal alloy, and may be fabricated by casting, die-casting, or other method. It should also be appreciated that the support rails 88 may also have a decorative finish resembling brushed aluminum, brushed nickel, stainless steel finish, and so forth. The support rails 88 include a bottom surface 92, and the bottom surface 92 has a channel 94 defined therein that extends from the front to the rear of the crisper drawer frame structure 74. The channel 94 is sized to receive the downwardly projecting rail 90 disposed in a channel 96 proximate an upper portion of each of the side walls 64, 66, as shown in FIGS. 6 and 7.

The glass panel 76 preferably serves as the lower shelf 46 within the food storage compartment 14 and also forms a closure for the crisper drawers 48, 50 when the crisper drawers 48, 50 are moved from an open position to a closed position. While in this embodiment the glass panel 76 is depicted as a clear, tempered glass panel, it should be appreciated that in other embodiments the glass panel 76 may frosted or coated. The glass panel 76 may also be formed of any material that provides glass-like properties (e.g., glass, tempered glass, frosted glass, tempered glass with a fully- or partially-applied coating, etc.). A resilient channel 98 is provided about the inner upper edge 100 of the perimeter of the crisper drawer frame structure 74, as shown in FIGS. 6 and 7. The resilient channel 98 is sized to fittingly and snuggly receive and support an outer edge of the glass panel 76.

Handles 58 provided on the front wall 60 of the crisper drawers 48, 50 by which the crisper drawers 48, 50 may be manually grasped by a user and moved between the opened and the closed positions are preferably integrally formed as a downwardly extending flange 102 disposed at an upper portion 104 of the front wall 60 that extends across the entire width of each of the crisper drawers 48, 50.

Figure 4:
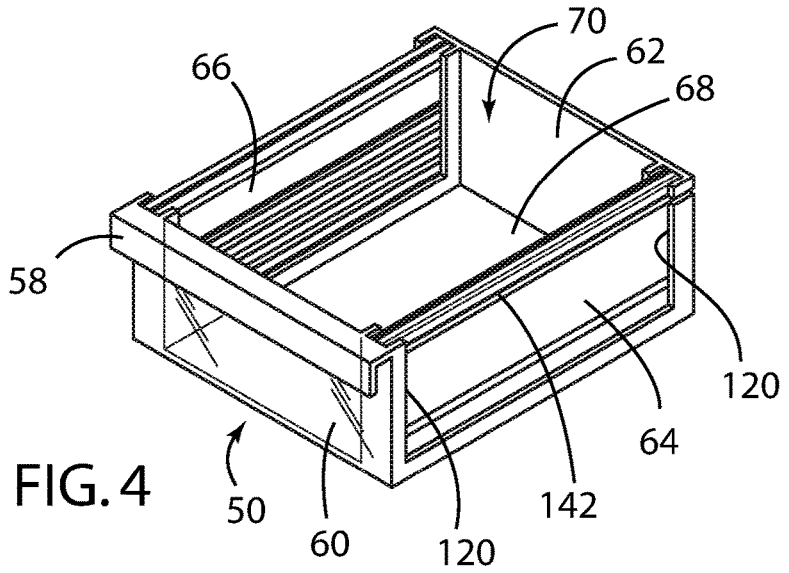
FIG. 4 is a front perspective view of the crisper drawer shown in FIG. 2 adapted to employ the integrated accessory interface of the present disclosure.

The front wall 60, back wall 62, and bottom wall 68 of the crisper drawers 48, 50 are preferably formed as a single monolithic component fabricated from a polymer material, such as polypropylene, as shown in FIG. 4. The polypropylene is opaque or colored, but in other embodiments the polypropylene may be clear. It will also be appreciated that in other embodiments the front wall 60, back wall 62, and bottom wall 68 may be formed from a metallic material, such as, for example, aluminum, steel, or metal alloy, and may be fabricated by extrusion, casting, die-casting, or other method. It should also be appreciated that the front wall 60, back wall 62, and bottom wall 68 may also have a decorative finish resembling brushed aluminum, brushed nickel, stainless steel finish, and so forth.

Each of the front wall 60, back wall 62, and bottom wall 68 of the crisper drawers 48, 50 have an upwardly-facing channel 106 defined on the side edges 108 therein that extends contiguously from the front wall 60 to the bottom wall 68 and to the back wall 62 of the crisper drawers 48, 50. The channel 106 is preferably defined by an outer flange 110 and an inner flange 112 which extend along the front wall 60, back wall 62, and bottom wall 68.

Each of the pair of side walls 64, 66 preferably includes a body 114 having a vertical cross-sectional profile of a predetermined thickness, an inner surface 116, and an outer surface 118. The inner surface 116 of each of the side walls 64, 66 of the crisper drawers 48, 50 is preferably substantially vertically planar, as further described below. The pair of opposed side walls 64, 66 are positioned on each side of the crisper drawers 48, 50 and are received within the upwardly-facing channel 106. The outer flange 110 and the inner flange 112 extend from the front wall 60, bottom wall 68, and back wall 62 and the spacing between the outer flange 110 and the inner flange 112 preferably matches or slightly exceeds the predetermined thickness of the vertical cross-sectional profile of the side walls 64, 66. Thereby, the side walls 64, 66 are received within the outer flange 110 and the inner flange 112 upon assembly of the crisper drawers 48, 50. The respective ends 120 of the pair of opposed side walls 64, 66 are shaped to conform to the cross-sectional configuration of the side of the crisper drawers 48, 50, to thereby form a snug and substantially coupled relation with each of the front wall 60, bottom wall 68, and back wall 62. Additionally, a gasket 122 can be added to the interface between each of the side walls 64, 66 and the outer flange 110 or inner flange 112 to provide a substantially leak-proof structure when the crisper drawers 48, 50 are assembled. The side walls 64, 66 are preferably mechanically coupled with the crisper drawers 48, 50 by any known technique, such as hot staking or fasteners (not shown).

Each of the side walls 64, 66 of the crisper drawers 48, 50 is preferably formed as a single, horizontally extending monolithic body from extruded aluminum of sufficient strength to support food items placed in the crisper drawer. It should be appreciated that in other embodiments the side walls 64, 66 may be formed from another metallic material, such as, for example, a steel or a metal alloy, and may be fabricated by casting, die-casting, or other method. It should also be appreciated that the pair of side walls 64, 66 may also have a decorative finish resembling brushed aluminum, brushed nickel, stainless steel finish, and so forth. Preferably, reinforcing ribs 124 extend between the inner surface 116 and the outer surface 118.

In certain circumstances, it may be desirable to mount an accessory 130 within the food storage compartment 14 and, in particular, within the crisper drawers 48, 50. For example, devices 132 that contribute to the control of the humidity within the crisper drawer may be advantageous. Such devices 132 typically have a rectangular configuration, having four side walls 134, a top wall 136, and a bottom wall 138. However, given that the volume within a food storage compartment 14, including the crisper drawers 48, 50, is often limited, it is desirable that the accessory be somehow discreetly mounted within the crisper drawers 48, 50 so as to consume as little volume as possible and to be safely retained in position. It may be further advantageous that the accessory 130 be removably mounted within the food storage compartment 14.

Figure 5:
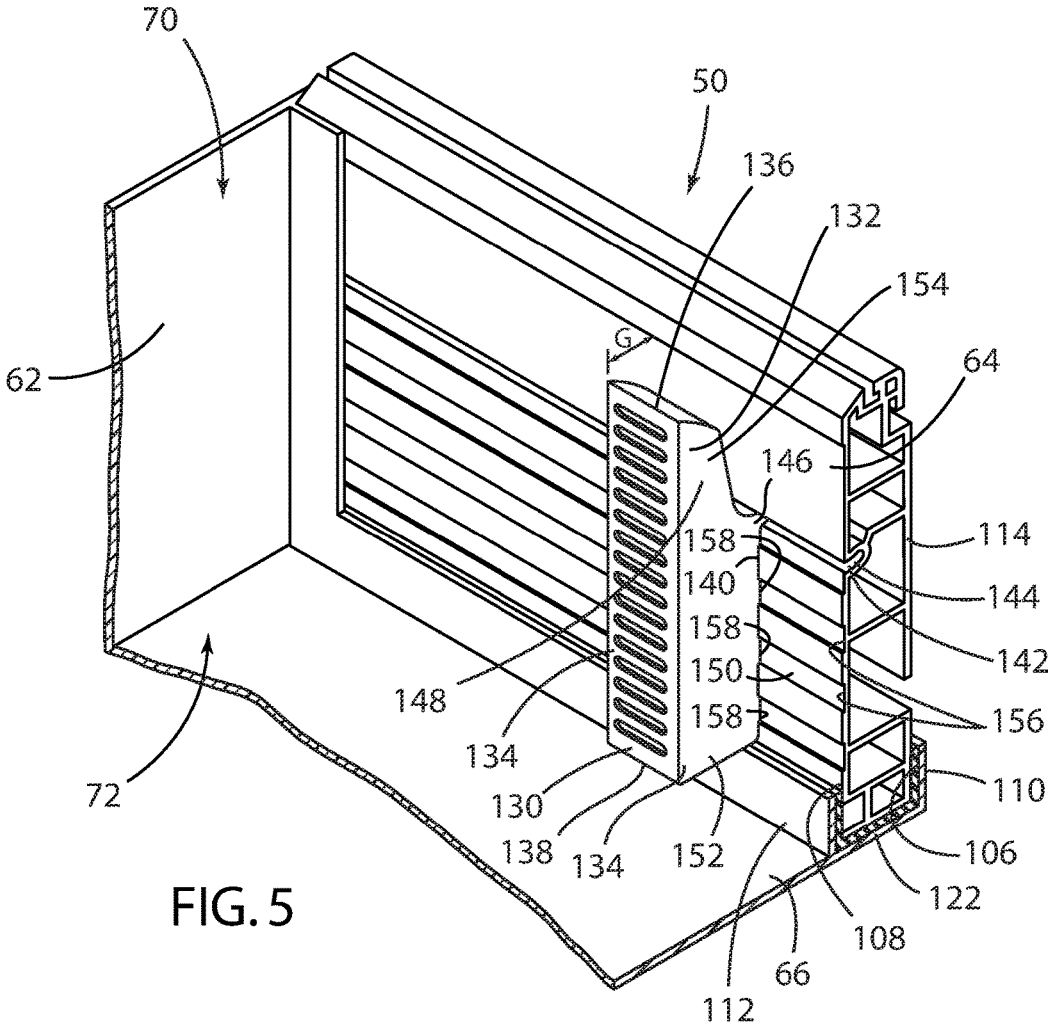
FIG. 5 is a side perspective view of the integrated accessory interface of the present disclosure.
Figure 8:
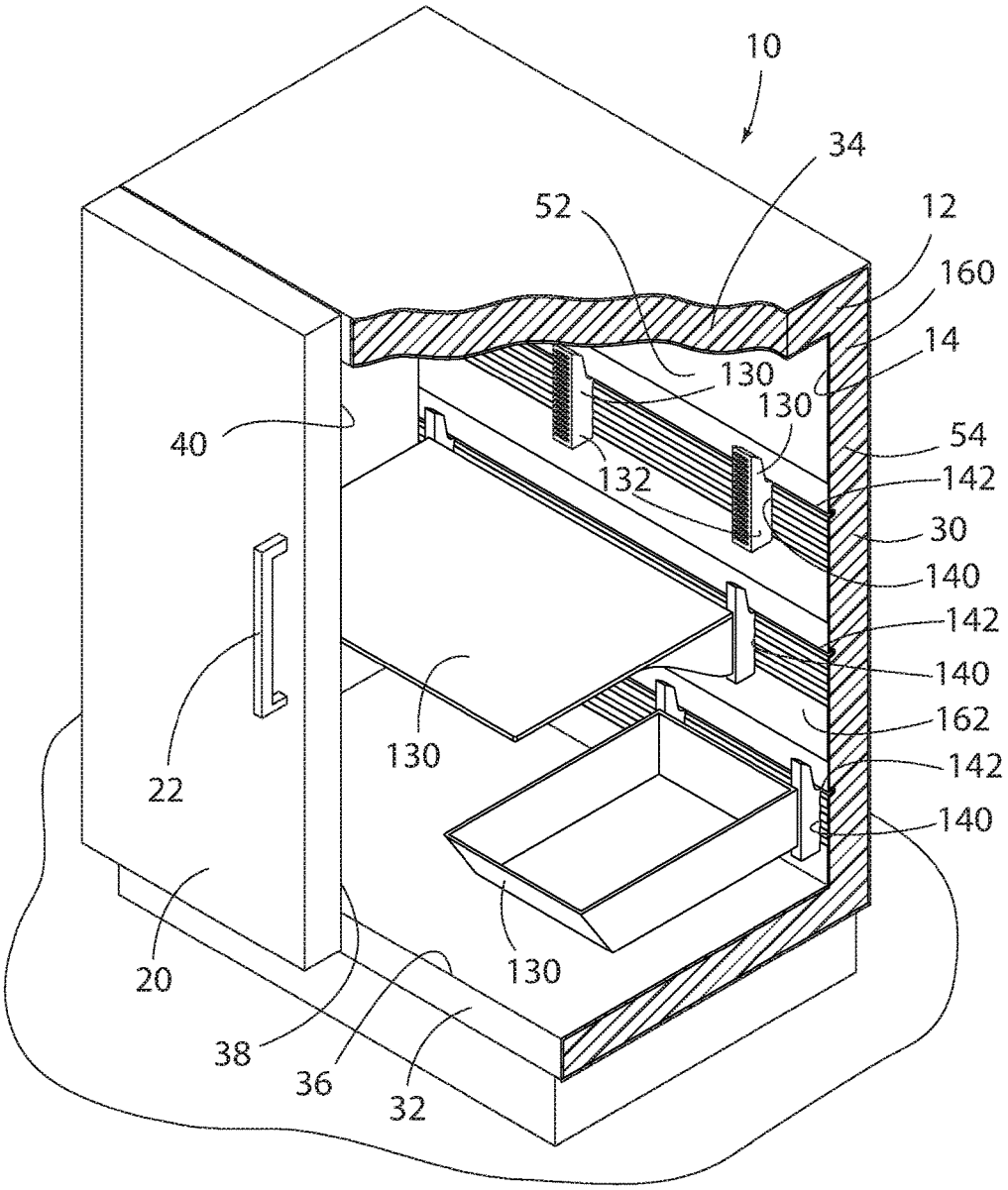
FIG. 8 is a front perspective view of another appliance cabinet having at least one food storage compartment adapted to employ the integrated accessory interface of the present disclosure.
Figure 9:
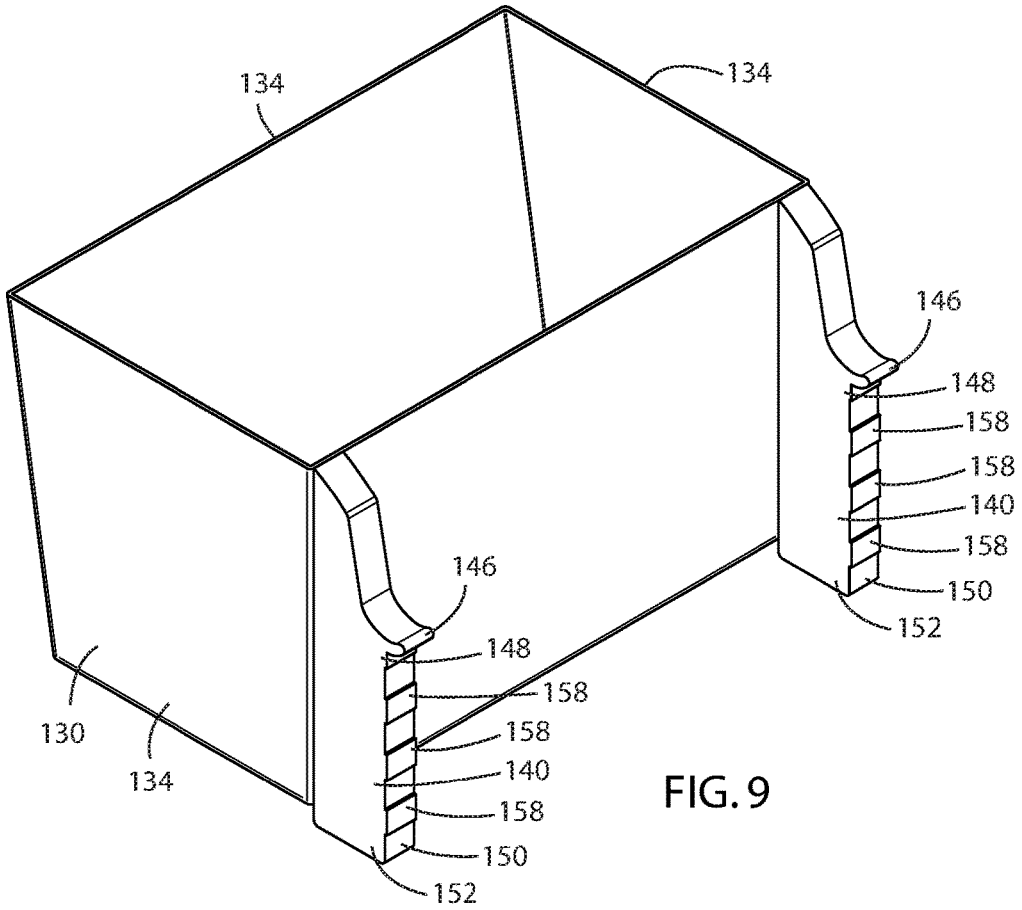
FIG. 9 is a front perspective view of an accessory adapted to employ the integrated accessory interface of the present disclosure.

The term "accessory" is defined herein as a housing, bin, tray, container, cartridge, or other structure sized to be positioned within a refrigerator compartment 16 and, more particularly, within a crisper drawers 48, 50, of a domestic refrigerator 10 and suitable for organizing, storing, or preserving food items. Further examples of accessories 130 include a storage bin sized to receive long-stem produce or a container having a number of wire baskets sized to receive small and delicate food items, such as mushrooms, tomatoes, Brussels sprouts cherry tomatoes, etc., as shown in FIGS. 8 and 9. Other accessories 130 may include food preservation agents or odor-removing agents, as shown in FIGS. 5-7. In each of the embodiments shown in FIGS. 5-9, the accessories 130 are formed by injection molding polypropylene. The polypropylene may be opaque or colored and in other embodiments the polypropylene may be clear. It should be appreciated that in other embodiments the accessories 130 may be formed from other plastic materials.

Thus, in accordance with an aspect of the improvement disclosed herein, an integrated accessory interface 140 is disclosed that allows the accessory 130 to be conveniently and removably mounted within the food storage compartment 14. The integrated accessory interface 140 includes a horizontally extending channel 142 defining an upwardly extending curvilinear cavity 144 disposed within the food storage compartment 14. In the case of the accessory 130 being removably mounted within the crisper drawers 48, 50, the horizontally extending channel 142 may be integrated with one or more of the opposed side walls 64, 66 of the crisper drawers 48, 50. In the preferred embodiment, the horizontally extending channel 142 is disposed on one or both of the inner surfaces 116 of the pair of opposed side walls 64, 66, as further described below.

The integrated accessory interface 140 also includes an upwardly extending curvilinear integral tab 146 disposed proximate an upper portion 148 of one of the side walls 134 of the accessory 130. The curvilinear integral tab 146 extends outwardly and upwardly from the accessory 130 and is adapted to engage the channel 142 to removably mount and retain the accessory 130 within the food storage compartment 14. As described further herein, the curvilinear integral tab 146 is adapted for smooth insertion within and removal from the horizontally extending channel 142. In particular, the cross-sectional profile of the curvilinear integral tab 146 is completely curved and sized to closely match the cross-sectional profile of the upwardly extending curvilinear cavity 144 so as to eliminate any mechanical interference with insertion and removal of the curvilinear integral tab 146 from the horizontally extending channel 142. More preferably, each of the upwardly extending curvilinear cavity 144 and curvilinear integral tab 146 have an identical curvature of a substantially constant radius. Thus, once installed, the accessory 130 is held in place by gravity, which places a counterclockwise force on the accessory 130 relative the exposed inner surface 116 disposed within the refrigerator compartment 16 (e.g., as shown in the orientation of FIG. 5). This urges the accessory 130 against the inner wall 116, with the curvilinear integral tab 146 restrained within the upwardly extending curvilinear cavity 144.

The integrated accessory interface 140 may comprise a pair of curvilinear integral tabs 146 disposed along a horizontal width of the upper portion 148 of the accessory 130, as shown in FIG. 9, where the accessory 130 is an open bin. Alternatively, as is the case when the accessory 130 is a humidity control device 132, as shown in FIG. 5, the curvilinear integral tab 146 of the integrated accessory interface 140 may extend substantially along an entire horizontal width of the upper portion 148 of the accessory 130.

The accessory 130 further preferably includes a facing wall 150 having a lower portion 152 below the curvilinear integral tab 146. In the case where a portion of the accessory 130 may extend above the curvilinear integral tab 146, as shown in FIGS. 5-9, a relief portion 154 is preferably provided above the curvilinear integral tab 146, the relief portion 154 forming a gap G between the accessory 130 above the curvilinear integral tab 146 and the inner surface 116 of the side walls 64, 66 of the crisper drawers 48, 50 when the curvilinear integral tab 146 is in engagement with the horizontally extending channel 142. This facilitates the insertion of the curvilinear integral tab 146 of the accessory 130 as the accessory 130 is inserted within the integrated accessory interface 140. That is, in either case, as the curvilinear integral tab 146 is inserted within the upwardly extending curvilinear cavity 144 of the horizontally extending channel 142, the accessory 130 rotates about a virtual pivot P formed by the interaction of the curvilinear integral tab 146 within the upwardly extending curvilinear cavity 144 of the horizontally extending channel 142, as shown in FIGS. 6 and 7. The relief portion 154 and resulting gap G above the curvilinear integral tab 146 is provided to facilitate such rotation in the case where a portion of the accessory 130 may extend above the curvilinear integral tab 146 provided on the accessory 130. In cases where there is no such portion extending above the curvilinear integral tab 146 provided on the accessory 130, no such relief is necessary.

The integrated accessory interface 140 preferably further includes a horizontally extending notch 156 disposed below the horizontally extending channel 142, and the accessory 130 further comprises a corresponding horizontally extending ridge 158 disposed on the facing wall 150 below the curvilinear integral tab 146 and received within the horizontally extending notch 156, as shown in FIGS. 5-8. Even more preferably, the integrated accessory interface 140 is provided with a plurality of horizontally extending notches 156 disposed below the horizontally extending channel 142 in regular vertical intervals, and the accessory 130 further comprises a plurality of horizontally extending ridges 158 disposed on the facing wall 150 below the curvilinear integral tab 146 in regular vertical intervals and received within the plurality of horizontally extending notches 156, the plurality of horizontally extending ridges 158 corresponding to the plurality of horizontally extending notches 156.

It should be appreciated that while a particular sizing and spacing of the horizontally extending notches 156 and the horizontally extending ridges 158 is shown in the drawings, the horizontally extending notches 156 and the horizontally extending ridges 158 may be larger or smaller or arranged differently in other embodiments. It should also be appreciated that in other embodiments the surfaces of the horizontally extending notches 156 and the horizontally extending ridges 158 may be smooth or may include a different texture.

In the preferred embodiment shown in FIGS. 5-7, the integrated accessory interface 140 allows an accessory 130 to be removably mounted within the crisper drawers 48, 50 slidably mounted within the food storage compartment 14. Even more preferably, the horizontally extending channel 142 of the integrated accessory interface 140 is integrated into one or more of the inner surfaces 116 of the horizontally extending extruded side wall 64, 66 of the crisper drawers 48, 50. However, it may be advantageous to dispose the horizontally extending channel 142 of the integrated accessory interface 140 on one of the vertically extending back wall 54 and pair of vertically extending opposed side walls 30 of the food storage compartment 14, as shown in FIG. 8.

As disclosed, the vertically extending back wall 54, as well as each of the pair of vertically extending opposed side walls 30, may comprise a liner 160 defining an exposed surface 162 of the vertically extending back wall 54 or side wall 30. In the case where the liner 160 is injection molded, the horizontally extending channel 142 may be integrally molded within the liner 160, as depicted in FIG. 8. Further, a plurality of horizontally extending notches 156 disposed below the horizontally extending channel 142 may be provided in regular vertical intervals that receive the plurality of horizontally extending ridges 158 provided on the facing wall 150 of the accessory 130. As also shown in FIG. 8, it may be advantageous to provide a plurality of sets of integrated accessory interfaces 140 comprised of horizontally extending channels 142 and associated horizontally extending notches 156 integrally molded with the liner 160 and disposed in regular vertical intervals on the exposed surface 162 of the liner 160 to allow flexibility in mounting the accessory 130 in multiple vertical locations.

Preferably, as in the case with the opposed side walls 64, 66 of the crisper drawers 48, 50, the horizontally extending channel 142 and plurality of horizontally extending notches 156 of the integrated accessory interface 140 extend substantially across the entire width of the vertically extending back wall 54. Such a structure provides improved adjustability of the mounting of the accessory 130 relative the food storage compartment 14. Such a structure likewise provides easy installation and removal of multiple accessories 130 at different horizontal locations along the integrated accessory interface 140 across the horizontal width of the vertically extending back wall 54 or, in the case where the integrated accessory interface 140 is mounted on the pair of opposed side walls 30, on the side walls 30 as well.

As a further alternative of the present disclosure, the integrated accessory interface 140 may be provided on a horizontally extending extruded body 114 having a vertical cross-sectional profile and an exposed inner surface 116 that is, in turn, mounted to one of the vertically extending back wall 54 and pair of vertically extending opposed side walls 30. As in the case where the horizontally extending extruded body 114 forms a side wall 64, 66 of the crisper drawers 48, 50, the horizontally extending channel 142 is formed within the exposed inner surface 116 of the horizontally extending extruded body 114 and extends substantially across a width of the horizontally extending extruded body 114.

In operation, the integrated accessory interface 140 of the present disclosure is exceedingly simple to operate. With the horizontally extending channel 142 disposed within the food storage compartment 14, and the upwardly extending curvilinear integral tab 146 provided proximate an upper portion 148 of the facing wall 150 of the accessory 130, the curvilinear integral tab 146 extends outwardly and upwardly from the facing wall 150 and is adapted to engage the horizontally extending channel 142 to removably mount and retain the accessory 130 within the food storage compartment 14. In order to engage the integrated accessory interface 140, all that is necessary is that the curvilinear integral tab 146 be inserted within the horizontally extending channel 142. As the accessory 130 is inserted within the integrated accessory interface 140, it rotates about the virtual pivot P formed by the interaction of the curvilinear integral tab 146 within the upwardly extending curvilinear cavity 144 of the horizontally extending curvilinear channel 142, as shown in FIGS. 6 and 7. After installation is substantially obtained and as the accessory 130 is released, gravity further rotates the accessory 130, whereby the horizontally extending ridges 158 on the facing wall 150 of the accessory 130 are brought into alignment and engagement with the plurality of horizontally extending notches 156 on the wall 64, 66 of the crisper drawers 48, 50 or the walls 54, 30 of the food storage compartment 14 below the horizontally extending channel 142 to provide an additional operative coupling via a mechanical interface. Removal of the accessory 130 is the simple reversal of this operation. No tools are required and no further manipulation of the accessory 130 is required in order to effectuate either installation or removal of the accessory 130 from the food storage compartment 14. Also, since the curvilinear integral tab 146 is smoothly received within the horizontally extending channel 142, there is no need to apply any force to insert or withdraw the curvilinear integral tab 146 other than supporting the weight of the accessory 130, greatly easing installation and removal.

Those skilled in the art will recognize, or will be able to ascertain using no more than routine experimentation, many equivalents to the specific embodiments of the invention described herein. Such equivalents are intended to be encompassed by the following claims.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

It will be understood by one having ordinary skill in the art that construction of the present disclosure and other components is not limited to any specific material. Other exemplary embodiments of the disclosure disclosed herein may be formed from a wide variety of materials, unless described otherwise herein.

It is also important to note that the construction and arrangement of the elements of the present disclosure as shown in the exemplary embodiments is illustrative only. Although only a few embodiments of the present innovations have been described in detail in this disclosure, those skilled in the art who review this disclosure will readily appreciate that, unless otherwise described, many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating positions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. An appliance comprising:

an appliance cabinet having at least one food storage compartment;

an accessory removably mounted within the food storage compartment; and an integrated accessory interface comprising a horizontally extending channel defining an upwardly extending curvilinear cavity disposed within the food storage compartment, and an upwardly extending curvilinear integral tab disposed proximate an upper portion of the accessory, the curvilinear integral tab extending outwardly and upwardly from the accessory and adapted to engage the channel to removably mount and retain the accessory within the appliance cabinet, wherein the curvilinear integral tab of the accessory is rotationally received within the horizontally extending channel and each of the upwardly extending curvilinear cavity and upwardly extending curvilinear integral tab have an identical curvature of a substantially constant radius;

wherein the integrated accessory interface further comprises a plurality of horizontally extending notches disposed below the horizontally extending channel and the accessory further comprises a plurality of corresponding horizontally extending ridges disposed below the curvilinear integral tab and received within the plurality of horizontally extending notches; and wherein the plurality of horizontally extending notches are disposed below the horizontally extending channel in regular vertical intervals and the plurality of horizontally extending ridges are disposed below the curvilinear integral tab in regular vertical intervals and received within the plurality of horizontally extending notches, the plurality of horizontally extending ridges corresponding to the plurality of horizontally extending notches.

2. The appliance of claim 1, wherein the integrated accessory interface comprises a pair of curvilinear integral tabs disposed along a horizontal width of the upper portion of the accessory.

3. The appliance of claim 1, wherein the curvilinear integral tab of the integrated accessory interface extends substantially along an entire horizontal width of the upper portion of the accessory.

4. The appliance of claim 1 further comprising a crisper drawer slidably mounted within the food storage compartment, wherein the horizontally extending channel of the integrated accessory interface is integrated into a wall of the crisper drawer.

5. The appliance of claim 4, wherein the wall of the crisper drawer comprises a horizontally extending extruded body having a vertical cross-sectional profile, an inner surface, and an outer surface.

6. The appliance of claim 5, wherein the horizontally extending extruded body of the crisper drawer comprises reinforcing ribs extending between the inner surface and the outer surface.

7. The appliance of claim 5, wherein the horizontally extending channel of the integrated accessory interface is formed on the inner surface of the horizontally extending extruded body of the crisper drawer.

8. The appliance of claim 5, wherein the horizontally extending extruded body of the crisper drawer is constructed of extruded aluminum and the integrated accessory interface further comprises a single horizontally extending channel.

9. The appliance of claim 8, wherein the accessory further comprises a facing wall having a lower portion below the curvilinear integral tab upon which the plurality of horizontally extending ridges are disposed on the accessory and a relief portion above the curvilinear integral tab, the relief portion forming a gap between the accessory above the curvilinear integral tab and the wall of the crisper drawer when the curvilinear integral tab is in full engagement with the horizontally extending channel.

10. The appliance of claim 1, wherein the food storage compartment further comprises a vertically extending rear wall, a pair of vertically extending opposed side walls, a moveable closure panel, and a refrigeration system for providing relatively cooler air within the food storage compartment and the horizontally extending channel of the integrated accessory interface is disposed on one of the vertically extending rear wall and pair of vertically extending opposed side walls.

11. The appliance of claim 10, wherein the one of the vertically extending rear wall and the pair of vertically extending opposed side walls comprises a liner defining an exposed surface of one of the vertically extending rear wall and the pair of vertically extending opposed side walls and the horizontally extending channel is formed within the liner and extends substantially across a width of the one of the vertically extending rear wall and the pair of vertically extending opposed side walls.

12. The appliance of claim 11, wherein the liner is injection molded and the horizontally extending channel is integrally molded within the liner.

13. The appliance of claim 10, wherein the one of the vertically extending rear wall and the pair of vertically extending opposed side walls comprises a horizontally extending extruded body having a vertical cross-sectional profile and an exposed surface and the horizontally extending channel is formed within the exposed surface of the horizontally extending extruded body and extends substantially across a width of the horizontally extending extruded body.

* * * * *